US009157348B2

(12) United States Patent
Hodges

(10) Patent No.: US 9,157,348 B2
(45) Date of Patent: Oct. 13, 2015

(54) LUBRICATION SYSTEM FOR A TILTABLE ENGINE

(75) Inventor: Dean Dittmar Hodges, Lockport, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 840 days.

(21) Appl. No.: 13/363,131

(22) Filed: Jan. 31, 2012

(65) Prior Publication Data

US 2013/0192558 A1 Aug. 1, 2013

(51) Int. Cl.
*F01M 11/00* (2006.01)
*F01M 11/06* (2006.01)

(52) U.S. Cl.
CPC ..... *F01M 11/064* (2013.01); *F01M 2011/0041* (2013.01)

(58) Field of Classification Search
CPC ..... F01M 2011/033
USPC ..... 123/196 R; 184/6.5
See application file for complete search history.

(56) References Cited

U.S. PATENT DOCUMENTS

| | | | | |
|---|---|---|---|---|
| 1,485,537 | A | 3/1924 | Vincent | |
| 1,674,103 | A | 6/1928 | Frederick | |
| 1,866,280 | A | 7/1932 | Woolson | |
| 2,550,967 | A | 5/1951 | Burks et al. | |
| 2,874,804 | A | 2/1959 | Haas | |
| 2,913,069 | A | 11/1959 | Kubis | |
| 3,590,953 | A | 7/1971 | Wellauer | |
| 2002/0003063 | A1 * | 1/2002 | Ito et al. | 184/6.5 |
| 2009/0139484 | A1 | 6/2009 | Harris | |
| 2010/0294231 | A1 | 11/2010 | Kusel | |
| 2011/0219751 | A1 | 9/2011 | Ibrahim et al. | |

FOREIGN PATENT DOCUMENTS

| | | | |
|---|---|---|---|
| GB | 705683 | A1 * | 3/1954 |
| JP | 403237207 | A | 10/1991 |

* cited by examiner

*Primary Examiner* — Lindsay Low
*Assistant Examiner* — Kevin Lathers
(74) *Attorney, Agent, or Firm* — Finnegan, Henderson, Farabow, Garrett & Dunner, LLP

(57) ABSTRACT

A lubrication system for an engine is provided. The lubrication system may include an oil pan configured to receive oil from the engine. The oil pan may have a first end, a second end opposite the first end, and a middle portion located between the first and second ends. The lubrication system may also include a suction pump configured to pump oil from the middle portion to the engine, a first conduit fluidly connected to the first end, a second conduit fluidly connected to the second end, and at least one pump fluidly connected to the first and second conduits. The at least one pump may be configured to direct oil from the first end toward the middle portion when the engine is tilted in a first direction and direct oil from the second end toward the middle portion when the engine is tilted in a second direction.

16 Claims, 3 Drawing Sheets

LUBRICATION SYSTEM FOR A TILTABLE ENGINE

TECHNICAL FIELD

The present disclosure relates generally to a lubrication system, and more particularly, to a lubrication system for an engine capable of tilting during operation.

BACKGROUND

Traditional lubrication systems circulate oil through an engine to lubricate moving parts, clean the engine, and cool the engine. In a wet sump engine, circulated oil is collected at the base of the engine, where it is pumped back into the engine by an oil pump. In a dry sump engine, circulated oil drains to the base of the engine and is subsequently pumped to an external reservoir by a scavenger pump. The oil is then pumped from the external reservoir back to the engine by a pressure pump.

Oil platforms utilize engine systems to drive machinery and to generate electricity. Severe weather conditions, such as hurricanes and strong winds, may cause the oil platforms to tilt. Both wet sump and dry sump engines may not function properly at tilted angles. When an engine is tilted, oil pools at the lowest point of the engine, which can be away from the associated pump. In such circumstances, either the oil pump (wet sump) or the scavenger pump (dry sump) may not have access to an adequate oil supply to properly lubricate, clean, and cool the engine. This can result in pump starvation and sub-optimal engine performance or even failure.

A system for supplying oil to an engine operating at tilted angles is described in U.S. Pat. No. 3,590,953 ("the '953 patent") of Wellauer that issued on Jul. 6, 1969. The '953 patent describes an engine having an oil pan. An enclosed compartment is formed within the oil pan that is only open to the oil pan by a vent hole. Two oil scavenging bells are located at the front and rear of the oil pan and communicate with an oil scavenging pump. The scavenging pump directs oil from the two scavenging bells into the enclosed compartment at a diffuser oil plate. A suction bell within the enclosed compartment communicates with a circulating pump to deliver oil to the engine.

Although the system of the '953 patent may be capable of operating at tilted angles, it may still be less than optimal. Specifically, because the system of the '953 patent requires an enclosed compartment and other modifications to the oil pan, the '953 system may be complicated and expensive.

The lubrication system and methods of the present disclosure solve one or more of the problems set forth above and/or other problems with existing technologies.

SUMMARY

In one aspect, the disclosure is directed to a lubrication system for an engine. The lubrication system may include an oil pan configured to receive oil from the engine. The oil pan may have a first end, a second end opposite the first end, and a middle portion located between the first and second ends. The lubrication system may also include a suction pump configured to pump oil from the middle portion to the engine, a first conduit fluidly connected to the first end of the oil pan, a second conduit fluidly connected to the second end of the oil pan, and at least one pump fluidly connected to the first and second conduits. The at least one pump may be configured to direct oil from the first end of the oil pan toward the middle portion of the oil pan when the engine is tilted in a first direction, and direct oil from the second end of the oil pan toward the middle portion of the oil pan when the engine is tilted in a second direction.

In another aspect, the disclosure is directed to a method of lubricating an engine. The method may include directing oil from a middle portion of an oil pan to the engine. The method may also include directing oil from a first end of the oil pan toward an opposing second end of the oil pan when the engine is tilted in a first direction, and directing oil from the second end toward the first end when the engine is tilted in a second direction.

DETAILED DESCRIPTION

Figure 1:
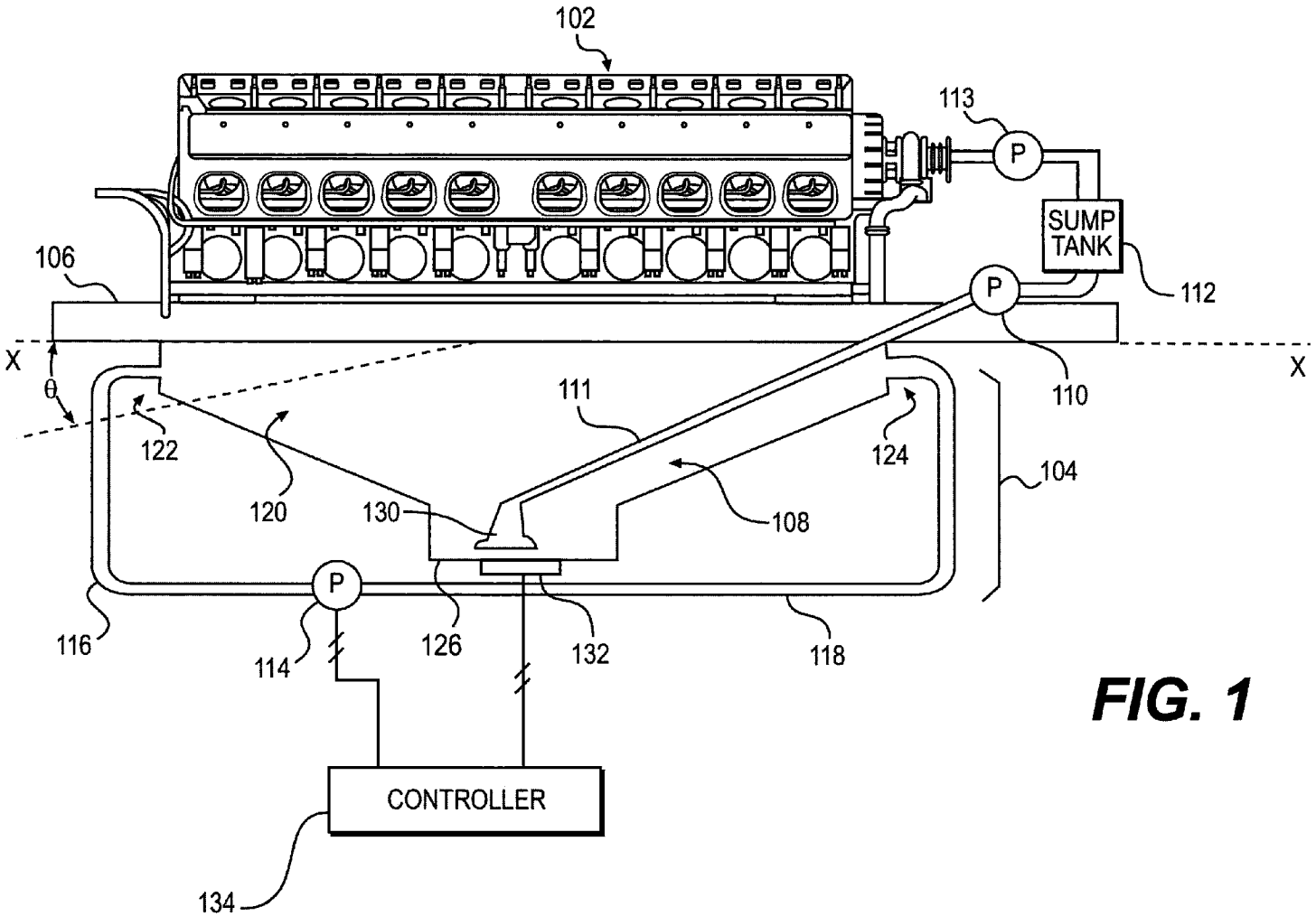
FIG. 1 is a diagrammatic illustration of an exemplary lubrication system.

FIG. 1 illustrates an engine 102 having an exemplary lubrication system 104. Engine 102 may be mounted to a platform 106. Platform 106 may be located on an oil platform, marine vessel, or any other suitable platform requiring an engine. Engine 102 is depicted in FIG. 1 and described herein as a diesel-fueled, internal combustion engine. However, it is contemplated that engine 102 may embody any other type of internal combustion engine, such as, for example, a gasoline or gaseous fuel-powered engine. It is contemplated that engine 102 may include any number of combustion chambers and that the combustion chambers may be disposed in an "in-line" configuration, a "V" configuration, or any other conventional configuration.

Lubrication system 104 may be connected to engine 102 and may include an oil pan 108, a suction pump 110, a suction conduit 111, a sump tank 112, and a pump 113. Oil pan 108 may be fluidically connected to sump tank 112 via suction pump 110 and suction conduit 111. Sump tank 112 may be fluidically connected to engine 102 via pump 113. Lubrication system 104 may also include a reversible pump 114 fluidically connected to a first conduit 116 and a second conduit 118.

Oil pan 108 may be connected to engine 102 to form a cavity known as a crankcase 120 located below engine 102. Oil pan 108 may have a first end 122, an opposing second end 124, and a middle portion 126. Oil pan 108 may be sloped from first end 122 to middle portion 126 when engine 102 is substantially level. Oil pan 108 may also be sloped from second end 124 to middle portion 126 when engine 102 is substantially level. Lubricant, for example engine oil, may be provided from oil pan 108 to engine surfaces to reduce metal-on-metal contact and thereby inhibit damage to the surfaces. Oil pan 108 may serve as a sump for collecting and supplying this lubricant. For example, middle portion 126 may be recessed to collect engine oil and may be configured to receive a suction bell 130 of suction conduit 111. Suction bell 130 may be trumpeted or may have any other known configuration. Engine oil may be pumped directly from middle portion 126 to engine 102 by suction pump 110. Alternatively, engine oil may be pumped from middle portion 126 to sump tank 112 by suction pump 110, and subsequently pumped to engine 102 by pump 113. It should be noted that FIG. 1 depicts only exemplary angles of oil pan 108 and middle portion 126 and that any other suitable sizes and shapes may alternatively be utilized.

Reversible pump 114 may provide directional control of engine oil within oil pan 108 between first end 122 and second end 124 via first conduit 116 and second conduit 118. First conduit 116 may be configured to receive engine oil at first end 122 of oil pan 108, and second conduit 118 may be configured to receive oil at second end 124 of oil pan 108. In one exemplary embodiment, reversible pump 114 may be an electric pump including a DC motor that can be operated in a first rotational direction and in a second, opposite rotational direction. Each rotational direction of the motor may correspond to a flow direction of engine oil through reversible pump 114. It should be noted however, that any other suitable configuration for reversing flow in reversible pump 114 may alternatively be utilized. Engine oil may be drawn from first end 122 by reversible pump 114 via first conduit 116 and pumped toward second end 124 via second conduit 118. Similarly, engine oil may be drawn from second end 124 via reversible pump 114 via second conduit 118 and pumped toward first end 122 via first conduit 116.

Lubrication system 106 may include a tilt sensor 132 configured to detect tilting of engine 102, and a controller 134 in communication with tilt sensor 132 and reversible pump 114. Tilt sensor 132 may be, for example, a gyroscope or an accelerometer. However, it should be noted that tilt sensor 132 may be any other suitable mechanism for detecting tilting of engine 102. Controller 134 may include all the components required to run an application such as, for example, a memory, a secondary storage device, and a processor, such as a central processing unit. One skilled in the art will appreciate that the controller 134 can contain additional or different components. Controller 134 may be dedicated to control of only lubrication system 104 or, alternatively, may readily embody a general engine microprocessor capable of controlling numerous engine functions. Associated with controller 134 may be various other known circuits such as, for example, power supply circuitry, signal conditioning circuitry, and solenoid driver circuitry, among others.

Controller 134 may be configured to adjust a pumping direction of reversible pump 114 based on an output of tilt sensor 132. That is, when tilt sensor 132 detects that engine 102 is tilted in a first direction (when first end 122 is below a reference plane X and second end 124 is above reference plane X), controller 134 may send a signal to reversible pump 114 to direct oil to middle portion 126 by pumping engine oil from first end 122 toward second end 124 via first conduit 116 and second conduit 118. Alternatively, when tilt sensor 132 detects that engine 102 is tilted in a second direction (when first end 122 is above reference plane X and second end 124 is below reference plane X), controller 134 may send a signal to reversible pump 114 to direct oil to middle portion 126 by pumping engine oil from second end 124 toward first end 122 via second conduit 118 and first conduit 116.

Controller 134 may be configured to start operation of reversible pump 114 when tilt sensor 132 detects a minimum tilt angle θ in either the first or second directions. The minimum tilt angle may be less than or equal to a rated operating angle of engine 102. For example, if engine 102 is rated to operate at a tilt angle of about +/−15 degrees, controller 134 may be configured to start reversible pump 114 when engine 102 is tilted about 12 degrees in the first or second direction. It should be noted, however, that engine 102 may have any other suitable rated operating angle and that controller 134 may utilize any other suitable minimum tilt angle to start reversible pump 114. Alternatively, controller 134 may start reversible pump 114 when engine 102 is tilted at an angle approximately equal to or greater than the rated operating angle of engine 102. Controller 134 may also be configured to start reversible pump 114 only when engine 102 is tilted to the minimum tilt angle for at least a minimum amount of time. Controller 134 may be configured to turn off reversible pump 114 when engine 102 is tilted at an angle less than or equal to the minimum tilt angle. In one exemplary embodiment, if engine 102 is rated to operate at a tilt angle of about +/−15 degrees, and the minimum tilt angle is about 12 degrees, controller 134 may be configured to turn off reversible pump 114 when engine 102 is tilted at about 10 degrees to prevent excessive cycling of engine oil. It should be noted however, that any other suitable angle may be utilized by controller 134 to turn off reversible pump 114.

Controller 134 may be configured to set a pumping displacement of reversible pump 114 based on the tilt of engine 102. That is, controller 134 may increase the displacement of reversible pump 114 as the tilt of engine 102 increases. As the tilt of engine 102 increases, more engine oil may pool at either first end 122 or second end 124. As more engine oil pools at first end 122 or second end 124, less engine oil is available to circulate through engine 102. To counter this effect, controller 134 may increase the displacement of reversible pump 114 as the tilt of engine 102 increases. Alternatively, to promote fuel efficiency, controller 134 may decrease the displacement of reversible pump 114 when the tilt of engine 102 decreases.

Figure 2:
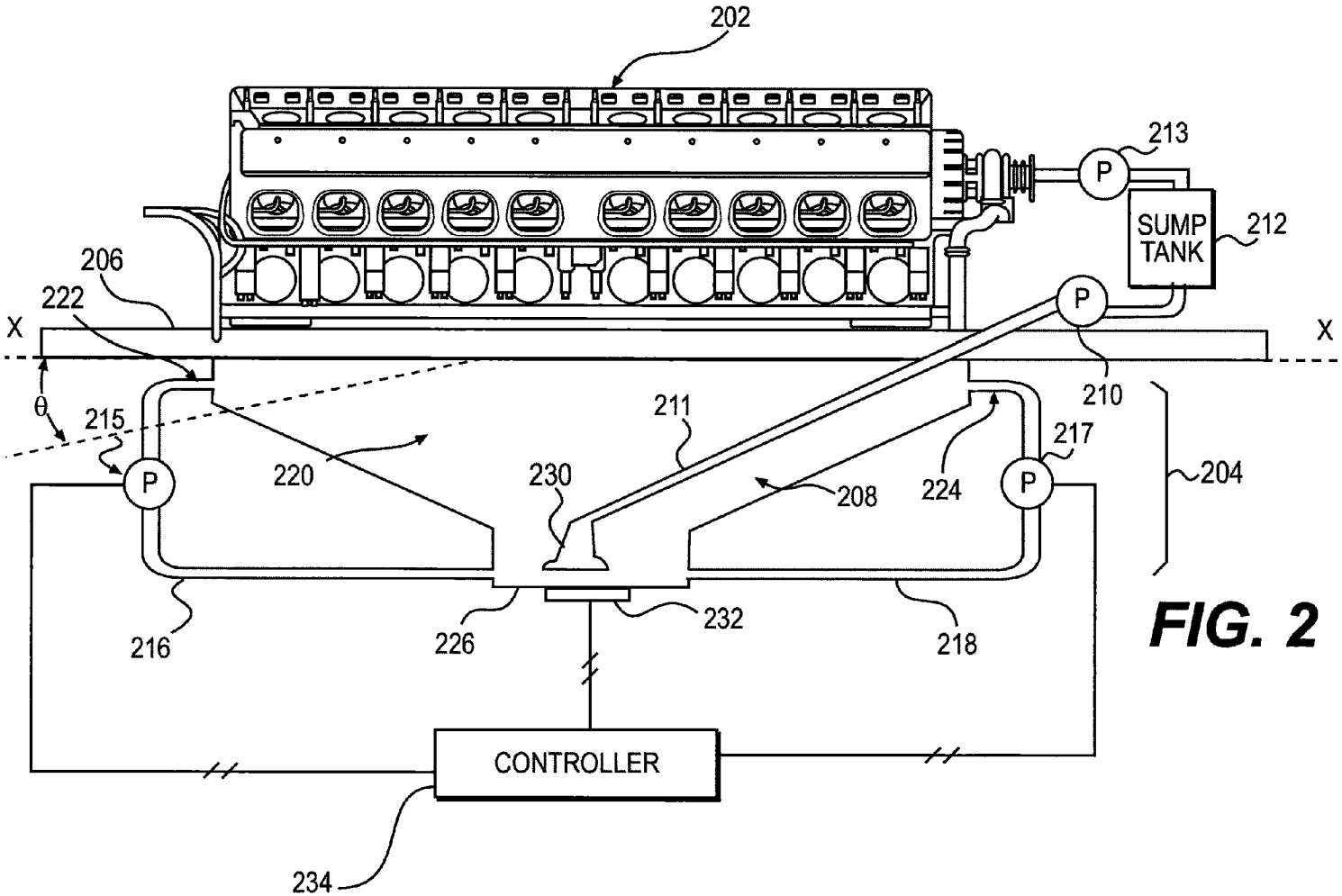
FIG. 2 is a diagrammatic illustration of another exemplary lubrication system.

FIG. 2 illustrates an alternative engine 202 having an exemplary lubrication system 204. Engine 202 may be mounted to a platform 206. Engine 202 and platform 206 may be substantially similar to engine 102 and platform 106 described in reference to FIG. 1. Lubrication system 204 may be connected to engine 202 and may include an oil pan 208, a suction pump 210, a suction conduit 211, a sump tank 212, and a pump 213. Oil pan 208 may be fluidically connected to sump tank 212 via suction pump 210 and suction conduit 211. Sump tank 212 may be fluidically connected to engine 202 via pump 213. Lubrication system 206 may also include a first pump 215, a first conduit 216, a second pump 217, and a second conduit 218. Oil pan 208 may be fluidically connected to first pump 215 and second pump 217 via first conduit 216 and second conduit 218 respectively.

Oil pan 208 may be connected to engine 202 to form a cavity known as a crankcase 220 located below engine 202. Oil pan 208 may have a first end 222, an opposing second end 224, and a middle portion 226. Oil pan 208 may be sloped from first end 222 to middle portion 226 when engine 202 is substantially level. Oil pan 208 may also be sloped from second end 224 to middle portion 226 when engine 202 is substantially level. Lubricant, for example engine oil, may be provided from oil pan 208 to engine surfaces to minimize metal-on-metal contact and thereby inhibit damage to the surfaces. Oil pan 208 may serve as a sump for collecting and supplying this lubricant. For example, middle portion 226 may be recessed to collect engine oil and may be configured to receive a suction bell 230 of suction conduit 211. Suction pump 210, suction conduit 211, sump tank 212, pump 213, and suction bell 230 may be substantially similar to suction pump 110, suction conduit 111, sump tank 112, pump 113, and suction bell 130. It should be noted that FIG. 2 depicts only exemplary angles of oil pan 208 and middle portion 226 and that any other suitable sizes and shapes may alternatively be utilized.

First pump 215 and second pump 217 may provide directional control of engine oil within oil pan 208. Oil pan 208 may be fluidically connected at middle portion 226 to a first conduit 216 and a second conduit 218. First conduit 216 may be fluidly connected to first pump 215 and may be configured to receive engine oil at first end 222 of oil pan 208. Engine oil may be drawn from first end 222 by first pump 215 via first conduit 216 and pumped toward middle portion 226. Similarly, second conduit 218 may be fluidly connected to second pump 217 and may be configured to receive engine oil at second end 224 of oil pan 208. Engine oil may be drawn from second end 224 by second pump 217 via second conduit 218 and pumped toward middle portion 226.

Lubrication system 204 may include a tilt sensor 232, and may also include a controller 234. Tilt sensor 232 and controller 234 may be substantially similar to tilt sensor 132 and controller 134 described in FIG. 1 except that controller 234 may be in communication with tilt sensor 232, first pump 215, and second pump 217.

Controller 234 may be configured to selectively determine which of first pump 215 or second pump 217 to operate based on an output of tilt sensor 232. That is, when tilt sensor 232 detects that engine 202 is tilted in a first direction (when first end 222 is below reference plane X and second end 224 is above reference plane X), controller 234 may send a signal to first pump 215 to direct engine oil from first end 222 toward middle portion 226 via first conduit 216. Alternatively, when tilt sensor 232 detects that engine 202 is tilted in a second direction (when first end 222 is above reference plane X and second end 224 is below reference plane X), controller 234 may send a signal to second pump 217 to direct engine oil from second end 224 to middle portion 226 via second conduit 218.

Controller 234 may be configured to start operation of first pump 215 when tilt sensor 232 detects a minimum tilt angle θ in the first direction. Similarly, controller 234 may be configured to start operation of second pump 217 when tilt sensor 232 detects a minimum tilt angle in the second direction. The minimum tilt angle may be less than or equal to a rated operating angle of engine 202. For example, if engine 202 is rated to operate at a tilt angle of about +/−15 degrees, controller 234 may be configured to start either first pump 215 or second pump 217 when tilt sensor 232 detects that engine 202 is tilted about 12 degrees in the first or second directions, respectively. It should be noted, however, that engine 202 may have any other suitable rated operating angle and that controller 234 may utilize any other suitable angle to start first pump 215 or second pump 217. Alternatively, controller 234 may start first pump 215 or second pump 217 when engine 202 is tilted at an angle approximately equal to or greater than the rated operating angle of engine 202. Controller 234 may also be configured to start first pump 215 or second pump 217 when engine 202 is tilted to the minimum angle for a minimum amount of time. Controller 234 may be configured to turn off first pump 215 or second pump 217 when engine 202 is tilted at an angle less than or equal to the minimum tilt angle. In one exemplary embodiment, if engine 202 is rated to operate at a tilt angle of about +/−15 degrees, and the minimum tilt angle is about 12 degrees, controller 234 may be configured to turn off first pump 215 or second pump 217 when engine 202 is tilted at about 10 degrees to prevent excessive cycling of engine oil. It should be noted however, that any other suitable angle may be utilized by controller 243 to turn off first pump 215 or second pump 217.

Controller 234 may be configured to set a pumping displacement of first pump 215 and second pump 217 based on the tilt of engine 202. That is, controller 234 may increase the displacement of first pump 215 or second pump 217 as the tilt of engine 202 increases. As the tilt of engine 202 increases, more engine oil may pool at either first end 222 or second end 224. As more engine oil pools at first end 222 or second end 224, less engine oil is available to circulate through engine 202. To counter this effect, controller 234 may increase the displacement of first pump 215 and second pump 217 as the tilt of engine 202 increases. Alternatively, to promote fuel efficiency, controller 234 may decrease the displacement of first pump 215 and second pump 217 when the tilt of engine 202 decreases.

Figure 3:
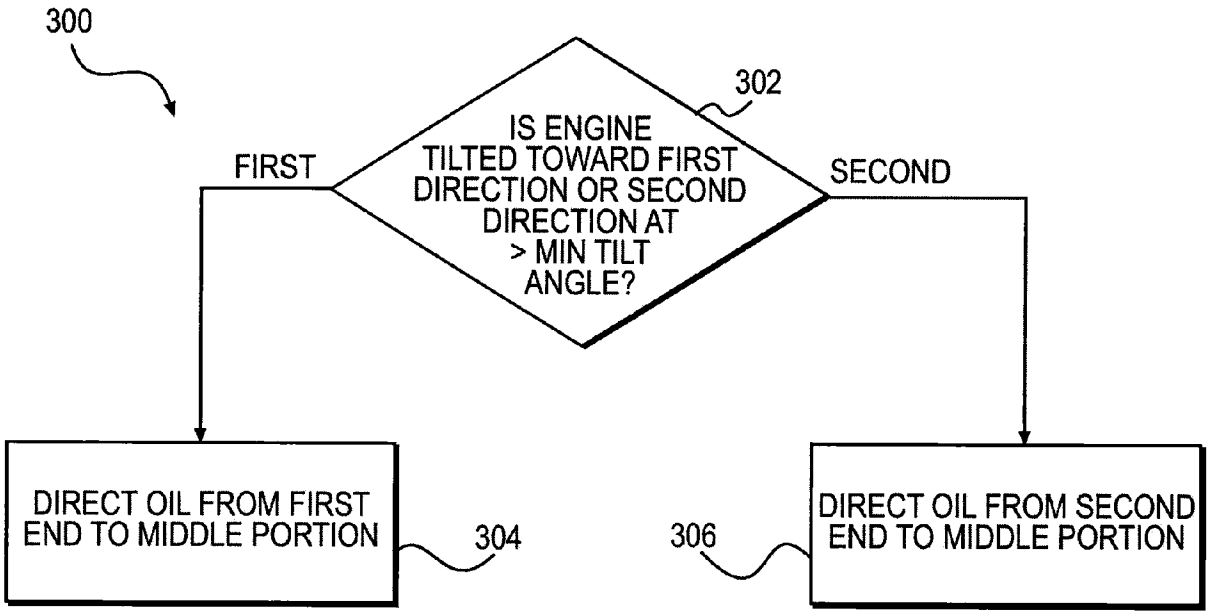
FIG. 3 is a flowchart illustrating an exemplary disclosed method performed by the lubrication systems of FIG. 1 and FIG. 2.

FIG. 3 illustrates an exemplary operation of lubrication systems 104 and 204. FIG. 3 will be discussed in more detail below.

INDUSTRIAL APPLICABILITY

The disclosed lubrication system may be applicable to any tiltable engine, and allow tiltable engines to operate at larger tilt angles. The disclosed lubrication system may also be retrofit onto existing engines not rated to operate at tilted angles to allow these existing systems to now be classified as tiltable. The disclosed lubrication system may help avoid pump starvation in any engine by pumping oil from pooled locations to an associated suction pump. An exemplary method will now be described.

According to flowchart 300 in FIG. 3, controllers 134, 234 may determine if engines 102, 202 are tilted at an angle greater than the minimum tilt angle in either a first or second direction based on an output of tilt sensors 132, 232 (Control Block 302). When controllers 134, 234 determine that engines 102, 202 are tilted in a first direction (when first ends 122, 222 are below reference plane X and second ends 124, 224 are above reference plane X), controllers 134, 234 may control reversible pump 114 and first pump 215 to direct oil from first ends 122, 222 toward middle portions 126, 226 at Control Block 304. In a first embodiment, controller 134 may direct oil from first end 122 toward middle portion 126 by sending a signal to reversible pump 114 to pump oil from first end 122 toward second end 124. Oil may then be gravitationally pulled from second end 124 to middle portion 126. In an alternative embodiment, controller 234 may direct oil from first end 222 toward middle portion 226 by sending a signal to first pump 215 to pump oil from first end 222 toward middle portion 226.

When controllers 134, 234 determine that engines 102, 202 are tilted in the second direction (when first ends 122, 222 are above reference plane X and second ends 124, 224 are below reference plane X), controllers 134, 234 may control reversible pump 114 and second pump 217 to direct oil from second ends 124, 224 toward middle portions 126, 226 at Control Block 306. In a first embodiment, controller 134 may direct oil from second end 124 toward middle portion 126 by sending a signal to reversible pump 114 to pump oil from second end 124 toward first end 122. Oil may then be gravitationally pulled from first end 122 to middle portion 126. In an alternative embodiment, controller 234 may direct oil from second end 224 toward middle portion 226 by sending a signal to second pump 217 to pump oil from second end 224 toward middle portion 226.

The disclosed lubrication systems 104 and 204 may provide a simple and inexpensive mechanism for allowing engines to operate at tilted angles. For example, the disclosed lubrication systems may function without modifications or with only minor modifications to existing oil pans. The disclosed lubrication systems may also prevent unnecessary maintenance costs by preventing engine malfunctions that occur due to pump starvation. The disclosed lubrication systems may also reduce the amount of engine oil necessary to operate engine systems because less engine oil may pool away from an associated suction pump.

It will be apparent to those skilled in the art that various modifications and variations can be made to the disclosed lubrication system without departing from the scope of the disclosure. Other embodiments of the lubrication system will be apparent to those skilled in the art from consideration of the specification and practice of the lubrication system disclosed herein. It is intended that the specification and examples be considered as exemplary only, with a true scope of the disclosure being indicated by the following claims and their equivalents.

What is claimed is:

1. A lubrication system for an engine, comprising:

an oil pan configured to receive oil from the engine, the oil pan having a first end, a second end opposite the first end, and a middle portion located between the first and second ends;

a suction pump configured to pump oil from the middle portion to the engine;

a first conduit fluidly connected to the first end of the oil pan;

a second conduit fluidly connected to the second end of the oil pan;

at least one pump fluidly connected to the first and second conduits and configured to:

direct oil from the first end of the oil pan toward the middle portion when the engine is tilted in a first direction; and direct oil from the second end of the oil pan toward the middle portion when the engine is tilted in a second direction;

a tilt sensor configured to detect a tilt of the engine; and a controller in communication with the tilt sensor and the reversible pump, the controller configured to adjust a pumping direction of the reversible pump based on an output of the tilt sensor;

wherein the at least one pump is a reversible pump to:

pump oil from the first end of the oil pan toward the second end of the oil pan when the engine is tilted in the first direction; and pump oil from the second end of the oil pan toward the first end of the oil pan when the engine is tilted in the second direction.

2. The lubrication system of claim 1, wherein the controller is further configured to increase a displacement of the reversible pump as a tilt angle of the engine increases.

3. The lubrication system of claim 1, wherein the controller is further configured to start the reversible pump when the tilt of the engine is less than or equal to a rated operating angle of the engine.

4. The lubrication system of claim 1, wherein the at least one pump includes a first pump configured to pump oil from the first end toward the middle portion when the engine is tilted in the first direction, and a second pump configured to pump oil from the second end toward the middle portion when the engine is tilted in the second direction.

5. The lubrication system of claim 1, further including a sump tank connecting the suction pump with the engine.

6. The lubrication system of claim 5, further including an additional pump connecting the sump tank and the engine.

7. A method of lubricating an engine, comprising;

directing oil from a middle portion of an oil pan to the engine;

directing oil from a first end of the oil pan toward an opposing second end of the oil pan when the engine is tilted in a first direction; and directing oil from the second end toward the first end when the engine is tilted in a second direction;

further including detecting a tilt of the engine, wherein directing oil from the first end of the oil pan toward the second end of the oil pan or directing oil from the second end toward the first end occurs when a tilt angle of the engine is greater than a minimum tilt angle;

wherein directing oil from the first or second ends includes increasing a pumping displacement as the tilt angle of the engine increases.

8. The method of claim 7, wherein directing oil from the middle portion of the oil pan to the engine includes pumping oil through a sump tank external to the engine.

9. The method of claim 8, further including pumping oil from the sump tank to the engine through an additional pump.

10. The method of claim 7 wherein the oil directed from the first end toward the second end and the oil directed from the second end toward the first end is gravitationally pulled to the middle portion of the oil pan.

11. An engine system, comprising:

a platform; an engine mounted to the platform;

an oil pan configured to receive oil from the engine, the oil pan having a first end, a second end opposite the first end, and a middle portion located between the first and second ends;

a suction pump configured to pump oil from the middle portion to the engine;

a first conduit fluidly connected to the first end of the oil pan;

a second conduit fluidly connected to the second end of the oil pan;

at least one pump fluidly connected to the first and second conduits;

a tilt sensor configured to detect a tilt of the engine; and a controller in communication with the tilt sensor and the at least one pump, the controller configured to:

direct oil from the first end of the oil pan toward the middle portion when the engine is tilted in a first direction based on an output of the tilt sensor;

direct oil from the second end of the oil pan toward the middle portion when the engine is tilted in a second direction based on the output of the tilt sensor; and adjust a pumping direction of the at least one pump based on the output of the tilt sensor.

12. The engine system of claim 11, wherein the at least one pump is a reversible pump, wherein the controller is further configured to: pump oil from the first end of the oil pan toward the second end of the oil pan when the engine is tilted in the first direction; and pump oil from the second end of the oil pan toward the first end of the oil pan when the engine is tilted in the second direction.

13. The engine system of claim 12, wherein the controller is further configured to increase a displacement of the reversible pump as a tilt angle of the engine increases.

14. The engine system of claim 12, wherein the controller is further configured to start the reversible pump when the tilt of the engine is less than or equal to a rated operating angle of the engine.

15. The engine system of claim 11, wherein the at least one pump includes a first pump configured to pump oil from the first end toward the middle portion when the engine is tilted in the first direction, and a second pump configured to pump oil from the second end toward the middle portion when the engine is tilted in the second direction.

16. A lubrication system for an engine, comprising:

an oil pan configured to receive oil from the engine, the oil pan having a first end, a second end opposite the first end, and a middle portion located between the first and second ends;

a suction pump configured to pump oil from the middle portion to the engine;

a first conduit fluidly connected to the first end of the oil pan;

a second conduit fluidly connected to the second end of the oil pan; and at least one pump fluidly connected to the first and second conduits and configured to:

direct oil from the first end of the oil pan toward the middle portion when the engine is tilted in a first direction; and direct oil from the second end of the oil pan toward the middle portion when the engine is tilted in a second direction;

wherein the at least one pump is a reversible pump configured to:

pump oil from the first end of the oil pan toward the second end of the oil pan when the engine is tilted in the first direction; and pump oil from the second end of the oil pan toward the first end of the oil pan when the engine is tilted in the second direction; and wherein the lubrication system further includes:

a tilt sensor configured to detect a tilt of the engine; and a controller in communication with the tilt sensor and the reversible pump, the controller configured to adjust a pumping direction of the reversible pump based on an output of the tilt sensor.

* * * * *